United States Patent [19]

Porter

[11] 3,982,088

[45] Sept. 21, 1976

[54] HIGH-VOLTAGE ELECTRIC CIRCUIT BREAKER COMPRISING SERIES-CONNECTED VACUUM INTERRUPTER AND FLUID BLAST INTERRUPTER

[75] Inventor: Joseph W. Porter, Media, Pa.

[73] Assignee: General Electric Company, Philadelphia, Pa.

[22] Filed: Apr. 3, 1975

[21] Appl. No.: 564,963

[52] U.S. Cl. ..... 200/144 B; 200/148 R; 200/145

[51] Int. Cl.[2] ..... H01N 33/66

[58] Field of Search ..... 200/144 B, 148 R, 145

[56] References Cited

UNITED STATES PATENTS 3,244,842 4/1966 Kameyama et al. ..... 200/144 B

*Primary Examiner*—Robert S. Macon

*Attorney, Agent, or Firm*—J. Wesley Haubner; William Freedman

[57] ABSTRACT

This high voltage circuit breaker comprises a vacuum type interrupter and a fluid-blast type interrupter electrically connected in series and arranged to be opened substantially simultaneously so that concurrent arcing occurs in the two interrupters until about the time a natural current zero is reached. The vacuum interrupter is relied upon to withstand the usual recovery voltage during the initial period after arcing and the fluid-blast interrupter to withstand the recovery voltage after this initial period. Immediately after the circuit has been interrupted by this coaction of the two interrupters, the vacuum interrupter is closed while the fluid blast interrupter remains open, thus relieving the vacuum interrupter of continuing voltage appearing across the circuit breaker.

6 Claims, 3 Drawing Figures

HIGH-VOLTAGE ELECTRIC CIRCUIT BREAKER COMPRISING SERIES-CONNECTED VACUUM INTERRUPTER AND FLUID BLAST INTERRUPTER

BACKGROUND

This invention relates to a high-voltage electric circuit breaker that comprises a plurality of circuit interrupters that are electrically connected in series and are opened substantially simultaneously during a circuit-interrupting operation. More particularly, this invention relates to a circuit breaker of this type in which at least one of the interrupters is a vacuum-type circuit interrupter and the remaining interrupter or interrupters are of the fluid blast type. A circuit breaker of this general type is disclosed in U.S. Pat. No. 3,244,842-Kameyama et al.

In a high-voltage circuit breaker that utilizes series-connected interrupters, it is customary to provide voltage-grading means for distributing the circuit-breaker voltage in the desired manner between the interrupters. Such voltage-grading means typically comprises capacitors of appropriate size connected across the individual interrupters. Such voltage-distributing capacitors are relatively expensive, and it would be highly advantageous if they could be eliminated or at least reduced in number.

Accordingly, an object of my invention is to eliminate the need for at least some of the voltage-distributing capacitors that are typically connected across the individual interrupters of a circuit breaker comprising series-connected interrupters.

For improving the ability of a high-voltage circuit breaker to withstand the recovery voltage transient that is developed thereacross when the circuit breaker attempts to interrupt at a current zero, it is conventional to connect across the interrupters of certain high-voltage circuit breakers a relatively low-impedance capacitor or resistor that is effective to lower the rate of rise of the recovery voltage transient. This low-impedance capacitor or resistor is in addition to the above-described voltage-distributing capacitors.

Another object of my invention is to eliminate the need for such a low-impedance capacitor or resistor for reducing the rate of rise of the recovery voltage across the circuit breaker, as well as eliminating the need for at least some of the voltage-distributing capacitors across the individual interrupters.

SUMMARY

In carrying out the invention in one form, I provide a high-voltage circuit breaker that comprises a vacuum-type circuit interrupter and a fluid-blast type circuit interrupter. These interrupters are electrically connected in series and are arranged to be opened substantially simultaneously so that concurrent arcing occurs in the two interrupters until about the time a natural current zero is reached. The vacuum interrupter is characterized by an extremely high rate of dielectric recovery during the initial period after arcing and is therefore especially effective in withstanding the usual recovery voltage transient that builds up during this initial period. The fluid-blast interrupter is characterized by a much slower rate of dielectric recovery during this initial period, but if it can endure this initial period without breakdown, it can thereafter withstand much higher peak recovery voltages than the vacuum interrupter. I therefore rely upon the vacuum interrupter to withstand the recovery voltage during the initial period after arcing and the fluid-blast interrupter to withstand the recovery voltage after this initial period. Immediately after the circuit has been interrupted by the above-described cooperating action of the two interrupters, the vacuum interrupter is closed while the fluid-blast interrupter remains open, thus relieving the vacuum interrupter of continuing voltage appearing across the circuit breaker.

BRIEF DESCRIPTION OF DRAWINGS

For a better understanding of the invention, reference may be had to the drawings, wherein.

DETAILED DESCRIPTION OF PREFERRED EMBODIMENTS

Figure 1:
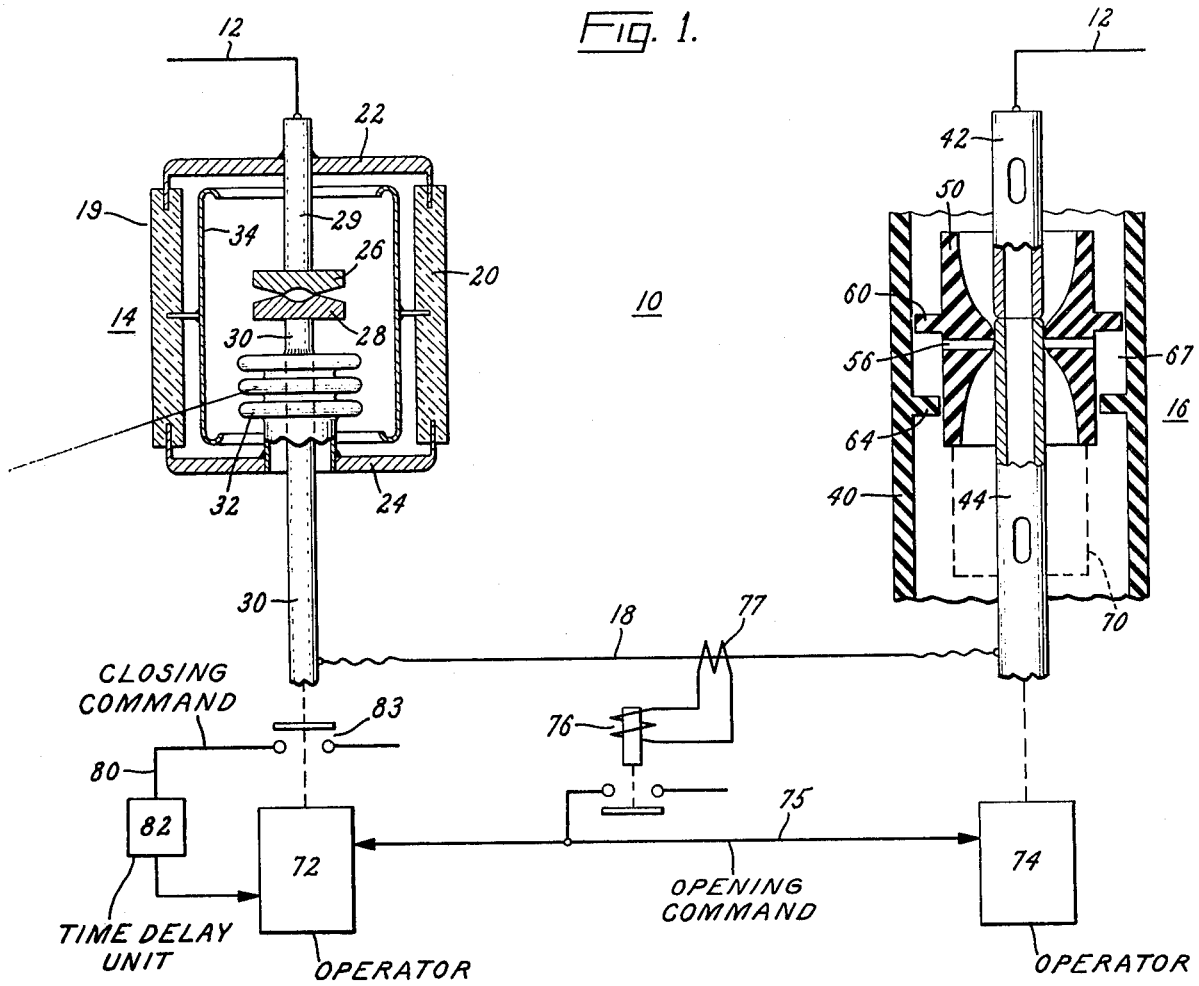
FIG. 1 is a schematic showing of a circuit breaker embodying one form of the invention.

Referring now to FIG. 1, there is shown a high voltage circuit breaker 10 that is connected in a high voltage power circuit 12. The circuit breaker comprises two circuit-interrupting devices 14 and 16 that are electrically connected in series in the power circuit by means comprising a conductor 18 extending between the interrupters. Interrupter 14 is a vacuum-type circuit interrupter, and interrupter 16 is a fluid-blast type of circuit interrupter, each of a generally conventional design.

The illustrated interrupter 14 comprises a highly-evacuated envelope 19 which comprises a tubular casing 20 of insulating material and a pair of metal end caps 22 and 24 sealed to the opposite ends of the casing. Within the highly-evacuated housing 19 is a pair of separable contacts 26 and 28. Contact 26 is a stationary contact joined to the lower end of a conductive contact rod 29 projecting through the top end cap 22 in sealed relationship. Contact 28 is a movable contact joined to the upper end of the movable conductive contact rod 30 projecting freely through the lower end cap 24. A flexible metal bellows 32 provides a seal about the contact rod 30 and permits longitudinal movement of the rod 30 without impairing the vacuum inside housing 19.

Opening of the interrupter 14 is effected by driving the rod 30 downwardly to separate movable contact 28 from stationary contact 26. This develops an arc between the contacts which persists until the next natural current zero, after which the arc is usually prevented from reigniting by the high dielectric strength of the vacuum. A tubular shield 34 surrounds the contacts in spaced relationship thereto to condense the metal vapors generated by the arc, thereby aiding the interrupter in recovering its dielectric strength after arcing. Reference may be had to U.S. Pat. No. 3,462,572-Sofianek, assigned to the assignee of the present invention, for a more detailed description of such an interrupter.

The illustrated interrupter 16 is a fluid-blast interrupter of the puffer type, such as shown, for example, in U.S. Pat. No. 3,739,125-Noeske, assigned to the assignee of the present invention. As such, it comprises an insulating housing 40 that is filled with a suitable arc-extinguishing gas at a moderate pressure, e.g., sulfur hexafluoride at a pressure of about 50 p.s.i. The interrupter further comprises a stationary rod contact 42 and a movable rod contact 44 that are shown in their closed position of engagement. Surrounding the rod contacts 42 and 44 is a nozzle 50 of electrical insulating material having a restricted throat intermediate its ends. Extending radially through the walls of nozzle 50 into the throat are a plurality of injection passages 56 through which arc-extinguishing gas can be injected into the throat region of the nozzle. The outer periphery of the nozzle carries a piston 60 that is slidable within cylindrical housing 40. An end wall 64 extends radially inward from the housing 40 and slidably receives the outer periphery of the nozzle 50. A cylinder space 67 is present between parts 60 and 64. When nozzle 50 is moved downwardly from its position of FIG. 1, the gas present in space 67 is compressed and forced from this space into the throat of the nozzle via injection passages 56.

Nozzle 50 is moved in a downward direction during opening by force transmitted from movable contact rod 44 to the nozzle through a linkage indicated schematically at 70. A suitable linkage for this purpose is disclosed in more detail in the aforesaid Noeske U.S. Pat. No. 3,739,125. When movable contact rod 44 is driven downwardly to open the interrupter 16, it separates from the stationary contact rod 42 thereby drawing an arc between the contact rods that extends through the throat of the nozzle. When the movable contact rod 44 has moved downwardly beneath the mouth of injection passages 56, compressed arc-extinguishing gas is driven radially inward through passages 56 to extinguish the arc, all as explained in detail in the aforesaid Noeske patent.

Circuit interruption is effected by opening the two interrupters substantially simultaneously. In the illustrated embodiment, this is done with two operators 72 and 74, one for each interrupter. When these operators receive an opening command through an input channel 75, each responds by immediately driving the contact rod of the associated interrupter downwardly through an opening stroke. In the schematically illustrated embodiment, the opening command is developed in response to operation of an overcurrent relay 76 inductively coupled to conductor 18 through a current transformer 77. When an overcurrent flows through the circuit breaker, relay 76 picks up, delivering an opening command to operators 72 and 74, which respond by simultaneously opening the two interrupters 14 and 16.

When the circuit breaker is thus opened, arcing occurs concurrently in the two interrupters until about the time a natural current zero is reached. Immediately thereafter the usual recovery voltage transient builds up across the two interrupters. As pointed out hereinabove, the vacuum interrupter is characterized by an extremely high rate of dielectric recovery during the initial period after arcing, and, with only a very small gap between the contacts, it can usually withstand the recovery voltage that appears across the interrupters during this initial period. The fluid-blast interrupter is characterized by a slower rate of dielectric recovery during this initial period, but if it can endure this initial period without breakdown, it can thereafter withstand much higher peak recovery voltages than the vacuum interrupter.

Figure 2:
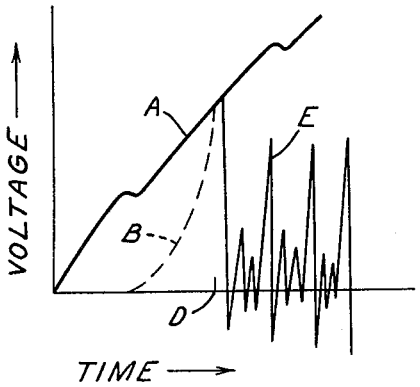
FIG. 2 is a graphic representation of certain voltagetime relationships present in the circuit breaker.

The voltage appearing across the two interrupters after current zero point has been reached is illustrated at A in FIG. 2. Initially, almost all the voltage A appears across the vacuum interrupter since the fluid-blast interrupter continues to admit a small amount of current through postarc conductivity. Finally, however, the fluid-blast interrupter recovers its dielectric strength as shown by the dotted line curve B. At instant D which typically is about 15 microseconds after initiation of the recovery voltage transient, the fluid blast interrupter has recovered its dielectric strength sufficiently to substantially prevent further post-arc conductivity. At about this time the recovery voltage has risen to such a high level that the vacuum interrupter can no longer withstand the voltage appearing thereacross, and it alternately sparks over and recovers at high frequency, as is indicated by the hash line E. The high frequency current that accompanies these repetitive spark-overs passes through the capacitance of the fluid-blast interrupter. This high frequency current is of a relatively low magnitude.

I allow this high frequency sparking to occur for only a limited period, terminating it by closing the vacuum interrupter 14 while leaving the fluid-blast interrupter 16 open. This period preceding vacuum interrupter reclosing is made long enough to assure that the interrupting operation is completed at the fluid-blast interrupter before the vacuum interrupter is reclosed. In a preferred form of the invention, I cause operator 72 to effect vacuum interrupter reclosing during a period of between 2 and 20 cycles of power frequency current after the vacuum interrupter has reached its fully open position. In the illustrated embodiment, the vacuum interrupter closing command is delivered to operator 72 through a closing-control channel 80 including a time-delay unit 82 and a *b* switch 83 on the vacuum interrupter, which switch closes when the vacuum interrupter reaches its fully open position. The time delay unit can be suitably preadjusted to impart whatever time delay is needed to effect reclosing of the vacuum interrupter in the required time.

When the vacuum interrupter is thus closed, all the circuit-breaker voltage is applied to the fluid-blast interrupter 16. The fluid-blast interrupter, because of its high dielectric capabilities, normally is able to withstand this full voltage without breakdown.

As mentioned hereinabove, the usual multi-interrupter high-voltage circuit breaker includes voltage-distributing capacitors connected across the individual interrupters. Since I rely upon the vacuum interrupter for withstanding voltage only during the initial period when the recovery voltage transient is building up, as above described, and not during subsequent intervals, I am able to dispense with these voltage-distributing capacitors in the embodiment of FIG. 1. The absence of the voltage-distributing capacitors is no serious handicap even during this initial period because post-arc conductivity in the fluid-blast interrupter during this initial period results in almost all the voltage appearing across the vacuum interrupter during this initial period, and this would be the case even if voltage-distributing capacitors had been present.

It will be apparent from the above description that when the vacuum interrupter is open and the fluid-blast interrupter is successfully withstanding circuit-breaker voltage, the voltage distribution between the interrupters is such that the above-described high-frequency sparking and clearing is occurring in the vacuum interrupter. No special effort is made to prevent such sparking while the vacuum interrupter is open.

Figure 3:
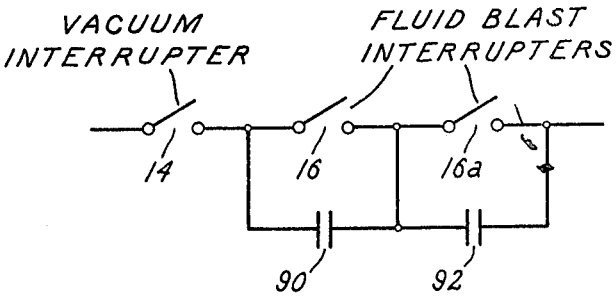
FIG. 3 is a diagrammatic showing of a modified circuit breaker.

In higher voltage circuit breakers it is necessary to provide additional interrupters in series, as compared to the two interrupters of FIG. 1, in order to accommodate the higher voltages. Such a higher voltage circuit breaker is shown in FIG. 3, where two fluid-blast interrupters 16 and 16*a* are connected in series with a single vacuum interrupter 14. As in FIG. 1, all the interrupters are arranged to be opened substantially simultaneously; and immediately after interruption is assured, the vacuum interrupter is closed while the two fluid-blast interrupters remain open. In the embodiment of FIG. 3, I connect voltage-dividing capacitors 90 and 92 across the individual fluid-blast interrupters but leave the vacuum interrupter 14 unshunted by such capacitors. The vacuum interrupter of FIG. 3 acts in the same manner as in FIG. 1, i.e., to impart a high rate of dielectric recovery during the initial period following arcing. Thereafter the circuit breaker voltage is divided between the interrupters 16 and 16*a* as determined by the sizes of the voltage-dividing capacitors 90 and 92. As in FIG. 1, the vacuum interrupter repetitively sparks over and clears at high frequency after the fluid-blast interrupters have interrupted, but this sparking is terminated by closing the vacuum interrupter 14 while the fluid-blast interrupters are still open, preferably within 2 to 20 cycles after the vacuum interrupter reaches its fully-open position.

In the embodiments of both FIG. 1 and FIG. 3, the absence of a voltage-dividing capacitor around the vacuum interrupter is advantageous in allowing the fluid-blast interrupter to recover its dielectric strength more rapidly during the initial period following arcing. In the absence of such capacitance, there is no significant path shunting the vacuum interrupter through which current can flow to feed and prolong the discharge that accompanies post-arc conductivity in the fluid blast interrupter. It is to be understood that this discharge is significantly different from a full-scale arc, which the fluid-blast interrupter would not be able to interrupt until the next natural current zero. The presence of the unshunted vacuum interrupter substantially helps to prevent this discharge from developing into a full-scale arc.

As mentioned in the introductory portion of this specification, it is conventional to connect across the interrupters of certain high voltage circuit breakers a low-impedance resistor or capacitor for reducing the rate of rise of the recovery voltage transient. In my circuit breaker, however, it is unnecessary to include such a resistor or capacitor because the vacuum interrupter's extremely high rate of dielectric recovery enables the breaker to successfully withstand the recovery voltage during the crucial initial period of recovery voltage transient build-up. The vacuum interrupter, in effect, relieves the fluid-blast interrupter from the recovery voltage transient during this initial period. Later, when the fluid-blast interrupter has had an opportunity to recover dielectric strength, it becomes the principal bearer of then-existing voltage of the recovery voltage transient, and the vacuum interrupter is allowed to spark over as indicated at E in FIG. 2.

While I have shown and described particular embodiments of my invention, it will be obvious to those skilled in the art that various changes and modifications may be made without departing from my invention in its broader aspects; and I, therefore, intend in the appended claims to cover all such changes and modifications as fall within the true spirit and scope of my invention.

What I claim as new and desire to secure by Letters Patent of the United States is:

1. A high-voltage alternating-current circuit breaker comprising:

a. a first circuit interrupter of the vacuum-type comprising a pair of contacts separable to establish an intercontact gap and a highly evacuated insulating housing enclosing said contacts, b. a second circuit interrupter of the fluid-blast type comprising a pair of contacts separable to establish an inter-contact gap and means for producing a fluid blast through said inter-contact gap upon contact separation, c. means connecting said first and second interrupters electrically in series, d. means for separating the contacts of said interrupters substantially simultaneously during circuit interruption to develop arcs across said gaps, e. said second interrupter being characterized by a slower dielectric recovery rate than said vacuum interrupter during the initial period when recovery voltage is being applied across said inter-contact gaps immediately following arc extinction but an ability to withstand higher peak recovery voltages than said vacuum interrupter after said initial period if no breakdown occurs during said initial period, f. and means for reclosing said vacuum interrupter immediately after said second interrupter has successfully withstood the recovery voltage applied thereacross and while said second interrupter remains open.

2. The high voltage circuit breaker of claim 1 in which said means for reclosing said vacuum interrupter completes reclosing of said vacuum interrupter during a period of between 2 and 20 cycles of power frequency current after said vacuum interrupter has been fully opened.

3. The high voltage circuit breaker of claim 1 in which said fluid-blast interrupter is an interrupter that utilizes for said fluid blast an arc-extinguishing fluid comprising sulfur hexafluoride.

4. A high voltage circuit breaker as defined in claim 1 in which:

a. there is included an additional circuit interrupter of the fluid-blast type electrically connected in series with said first and second interrupters and arranged to be opened substantially simultaneously with said first and second interrupters, b. there are provided voltage-distributing capacitors respectively connected across said second and third interrupters for distributing circuit-breaker voltage between said second and third interrupters, c. said first interrupter is substantially unshunted by capacitance connected thereacross, and d. said third interrupter remains open while said first interrupter is reclosed.

5. The high voltage circuit breaker of claim 4 in which said means for reclosing said vacuum interrupter completes reclosing of said vacuum interrupter during a period of between 2 and 20 cycles of power frequency current after said vacuum interrupter has been fully opened.

6. The high-voltage circuit breaker of claim 1 in which when said vacuum interrupter is open and said second interrupter is successfully withstanding circuit-breaker voltage, the circuit-breaker voltage is distributed between said interrupters in such a way that said vacuum interrupter is sparking over and clearing repetitively at high frequency.

* * * * *